United States Patent [19]

Suzuki et al.

[11] Patent Number: 4,829,873

[45] Date of Patent: May 16, 1989

[54] STRING FIXING DEVICE FOR STRING INSTRUMENTS

[75] Inventors: Yasuo Suzuki, Tokyo; Kiyoshi Minakuchi, Hamamatsu, both of Japan

[73] Assignee: Yamaha Corporation, Hamamatsu, Japan

[21] Appl. No.: 187,211

[22] Filed: Apr. 28, 1988

[30] Foreign Application Priority Data

Apr. 30, 1987 [JP] Japan ..... 62-66522[U]

[51] Int. Cl.[4] ..... G10D 3/12

[52] U.S. Cl. ..... 84/314 N

[58] Field of Search ..... 84/214, 314

[56] References Cited

U.S. PATENT DOCUMENTS

| | | | |
|---|---|---|---|
| 4,517,874 | 5/1985 | Fender | 84/314 N |
| 4,574,678 | 3/1986 | Edwards | 84/314 N |
| 4,608,906 | 9/1986 | Takabayashi | 84/313 |
| 4,669,350 | 6/1987 | Gressett et al. | 84/314 N |

*Primary Examiner*—Lawrence R. Franklin

*Attorney, Agent, or Firm*—Spensley Horn Jubas & Lubitz

[57] ABSTRACT

The string fixing device adopts lock members arranged on the top surface of a head near the boundary area between the neck and head of a string instrument. One end of the strings are fixedly sandwiched between a pressing member and the top surface of the lock member, thereby being fixed to the head. Since the lock member and the pressing member function as a nut, length of the string is determined as the length as measured from the bridge to the position fixedly sandwiched by the lock member. String height adjusting means adjusts height of the lock member as measured from the top surface of the head as occasion demands. As a result, the string fixing device adjusts, on one side, height of the string as measured from the head at the position sandwiched and fixed between the top surface of the lock member and the pressing member. Accordingly, the string fixing device permits easily adjusting the string to a height convenient for performance without machining the head or interposing an additional member such as a spacer between the head and the lock member. Further, since the strings are sandwiched and pressed directly between the pressing member and lock member, the string is always kept in close contact with the lock member, thereby preventing sound intervals of the strings from being delicately deviating even while the string is pressedly sandwiched and fixed by the pressing member.

4 Claims, 3 Drawing Sheets

STRING FIXING DEVICE FOR STRING INSTRUMENTS

BACKGROUND OF THE INVENTION (a) Field of the invention

The present invention relates to a string fixing device for string instruments, and more particularly to a device for fixing ends of strings on one side to the head or the similar part especially of electric guitars.

(b) Description of the prior art

On string instruments, especially electric guitars or the similar instruments, it is conventional to strongly fix the strings to prevent them from loosening during performance since loosening of the strings causes deviation of intervals. As the conventional string fixing devices for this purpose, there are known the devices, for example, shown in FIG. 1 (Japanese Utility Model Laid Open No. Sho 61-49393) and FIG. 2.

The string fixing device shown in FIG. 1 is of a type which is equipped with a nut 1 on the top surface of a neck 2 at the end thereof located on the side of a head 3, and the string fixing device is fixed on the top surface of the head 3. Speaking concretely, the string fixing device consists of a base plate 4 fixed on the head 3, a pressing piece 6 for pressing strings 5 onto the top surface of the base plate 4 and a screw 7 for fixing the pressing piece 6 to the base plate 4. Accordingly, height of the strings 5 over the neck 2 is adjusted by varying depths of the grooves formed in the nut 1. However, the string fixing device of this type poses a problem that the pressing piece 6 is apt to be floated up and sound intervals are delicately varied by clamping the pressing piece 6 when the grooves in the nut 1 are too shallow, or the strings 5 are apt to be floated up from the nut 1, thereby adversely affecting tone quality when the grooves in the nut 1 are too deep.

The string fixing device shown in FIG. 2 is arranged, in place of the nut, on the top surface of the boundary area between the neck 2 and the head 3. Speaking concretely, the string fixing device shown in FIG. 2 presses and fixes with the pressing piece 6 the strings 5 stretched between pegs 9 and a bridge (not shown) onto the top surface of the plate 4 fixed to the top surface of the head 5 by way of a spacer 8. The pressing piece 6 is fixed on the base plate 4 with a screw. Accordingly, height of the strings 5 is adjusted by interposing a spacer 8 having different thickness between the neck 2 and base plate 4 or cutting the top surface of the neck 2 since the base plate 4 of the string fixing device is made of a hard material taking friction with the string 5 into consideration.

However, these conventional string fixing devices pose problems that height of the strings is hardly adjustable with high precision, that the adjustment of string height is tedious since it requires cutting or the like of the neck other than the string fixing devices and that the string fixing devices are not suited for mass production.

SUMMARY OF THE INVENTION

In view of the above, it is a primary object of the present invention to provide a string fixing device for string instruments so adapted as to easily permit adjusting height of the strings for convenient performance without machining the head or interposing an adjusting member such as a spacer between the head and lock member.

Another object of the present invention is to provide a string fixing device for string instruments capable of preventing intervals of the strings from delicate deviation while the strings are kept fixed.

A third object of the present invention is to provide a string fixing device for string instruments suited for mass production.

According to the present invention, these objects can be accomplished by equipping with lock members arranged on the top surface of the boundary between the neck and head of a string instrument, pressing members capable of fixedly holding the strings between these members and the top surface of the lock members, and string height adjusting means capable of adjusting height of the lock members as measured from the top surface of the head.

The string fixing device for string instruments according to the present invention wherein the string height adjusting means are designed as screws screwed into the lock members and having tips capable of contacting a plate-like member fixed to the head, permits adjusting string position simply and easily to a height convenient for performance without machining the head or interposing an additional member such as a spacer between the head and the lock members. Further, since the strings are held by the pressing members directly between said members and the lock members, the strings are always kept in close contact with the lock members and the intervals of the strings can never be deviated delicately while the strings are fixed by the pressing members.

These and other objects as well as the features and advantages of the present invention will become more apparent from the following detailed description of the preferred embodiments when taken in conjunction with the accompanying drawings.

DESCRIPTION OF THE PREFERRED EMBODIMENTS

Figure 1:
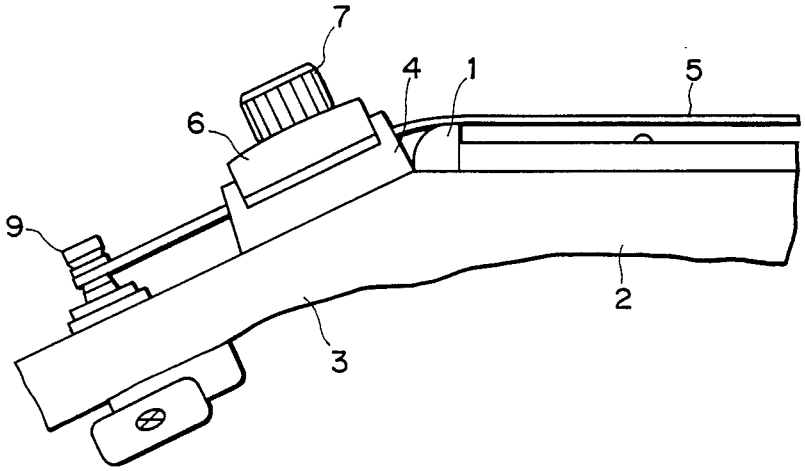
FIG. 1 PRIOR ART
FIG. 1 is a side elevation illustrating an example of the conventional string fixing devices.

Now, the preferred embodiments of the string fixing device according to the present invention will be described with reference to the accompanying drawings wherein the members similar to those of the conventional examples are represented by the same reference numerals.

Figure 3:
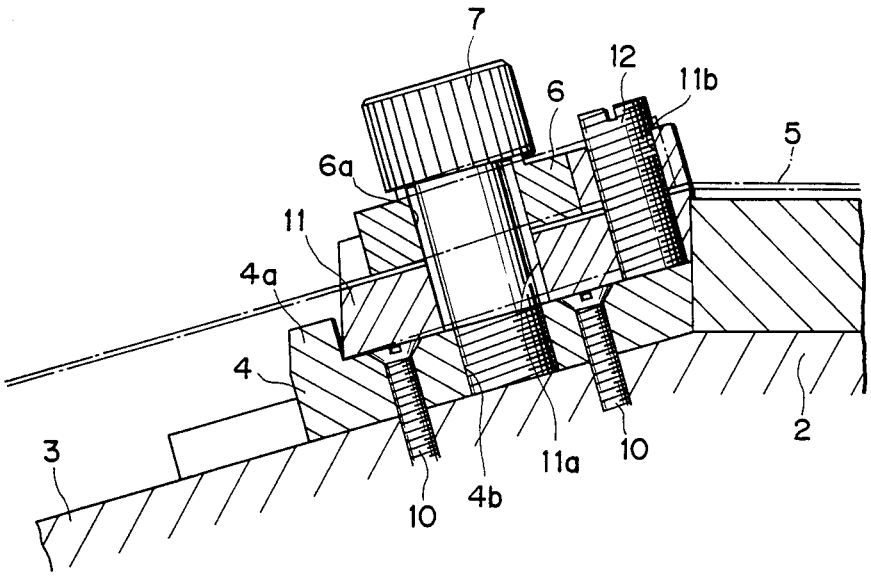
FIG. 3 is a sectional view of the main portion illustrating an embodiment of the string fixing device according to the present invention.
Figure 4:
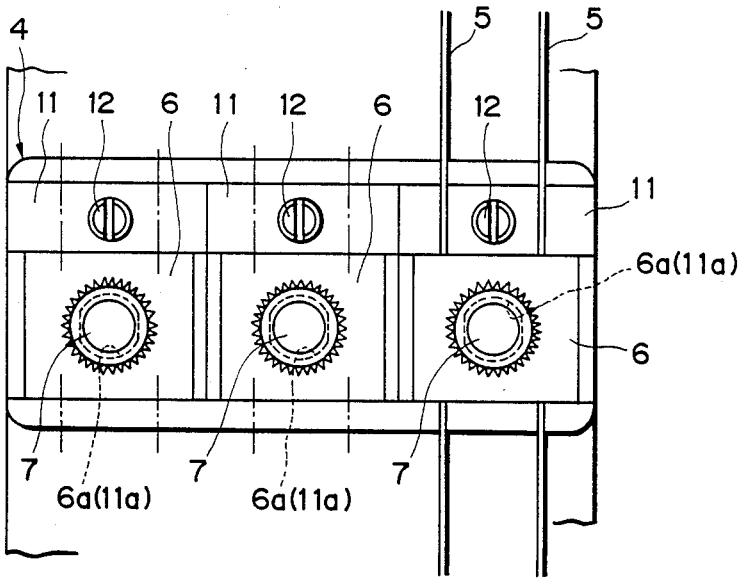
FIG. 4 is a plan view of the string fixing device shown in FIG. 3.

FIGS. 3 and 4 show an embodiment of the string fixing device for string instruments according to the present invention.

Figure 2:
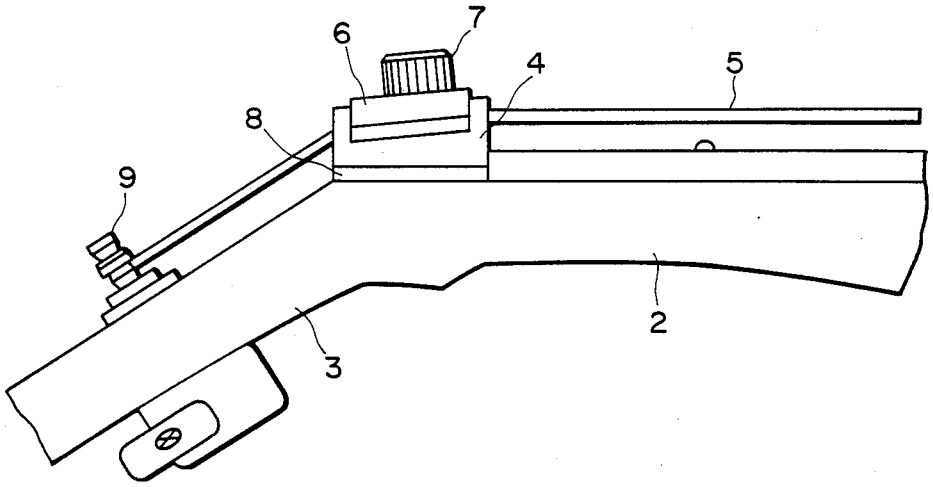
FIG. 2 PRIOR ART
FIG. 2 is a side elevation illustrating another example of the conventional string fixing devices.

As shown in these drawings, a base plate 4 is fixed with screws 10 to the top surface of a head 3 at the end on the side nearer a neck 2. Mounted on the base plate 4 are lock nuts 11 (lock member), ends of which are engaged with a protrusion 4*a* located at one end of the base plate 4 to determine the position in the string direction. Further, the wall surface at one end of the lock nut 11 is formed so as to have a predetermined angle smaller than 90°, for example 75°, relative to the bottom surface thereof, thereby allowing the lock nut 11 to rotate counterclockwise around the end functioning as the fulcrum. The lock nut 11 is arranged for each pair of the strings 5 and the string fixing device is equipped with three lock nuts 11 in total (See FIG. 2). The strings 5 are pressed onto the top surfaces of the lock nuts 11 with pressing members 6, which are designed as rectangular washers and fixed between the heads of string fixing screws 7 and the lock nuts 11. In other words, opening 6*a* and 11*a* for loosely inserting the screws 7 are formed in the rectangular washers 6 and lock nuts 11 respectively. In addition, the string fixing screws 7 are screwed into tapped holes 4*b* formed in the base plate 4 to fixedly sandwich the members 6 and 11. Formed in the other ends (nearer the neck 2) of the lock nuts 11 are tapped holes 11*b* which run through in the vertical direction and into which height adjusting bolts 12 of the lock nuts 11 are screwed. That is to say, when the adjusting bolts 12 are screwed into the tapped holes 11*b* and the lower ends of the bolts protrude from the tapped holes 11*b* to become contact with the top surface of the base plate 4, the lock nuts 11 are floated up from the top surface of the base plate 4 to adjust height of the strings 5. These adjusting bolts 12 constitute string height adjusting means which determine height of the strings 5 (height as measured from the finger board surface of the neck 2) by adjusting height of the lock nuts 11 as measured from the top surface of the head 3.

The string fixing device having the composition described above permits varying protrusion of the bolts 12 from the bottom surfaces of the lock nuts 11 and adjusting height of the lock nuts 11 as measured from the head 3 by varying screwed depths of the height adjusting bolts 12 of the lock nuts 11 (In FIG. 3, the chain lines indicate heights of the pressing member 6 and the lock nut 11 in the condition when the adjusting bolt is screwed deepest.) with the string fixing screws 7 loosened, after the strings are stretched, so as to form narrow gaps between the top surfaces of the rectangular washers 6 and the bottom surfaces of the heads of the string fixing screws 7. As a result, the string fixing device permits adjusting height of the strings 5 and determining height of the strings 5 convenient for performance. After the adjustment of the string height, the angular washers 6 and lock nuts 11 are fixed to the base plate 4 by screwing the string fixing bolts 7 into the tapped holes 4*b* of the base plate 4. Simultaneously, the strings 5 are fixedly sandwiched between the rectangular washers 6 and lock nuts 11. Further, since the height adjusting bolt 12 is provided for each lock nut 11, the height adjustment is possible for each pair of the strings 5.

Figure 5:
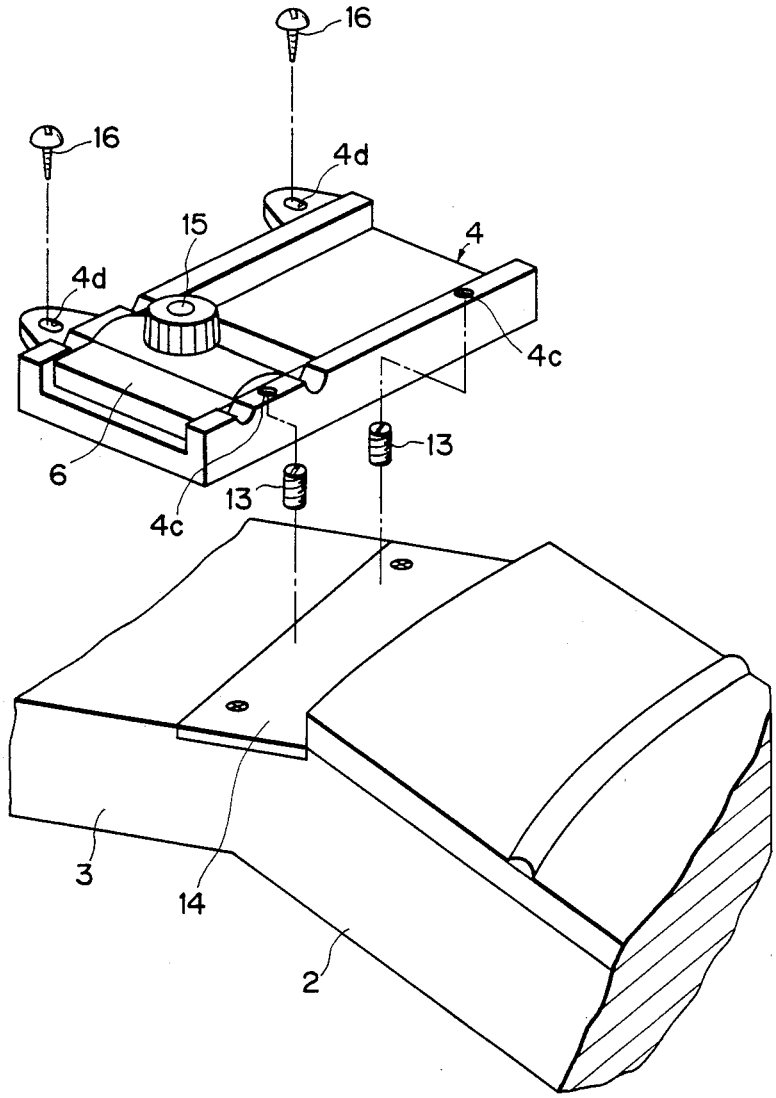
FIG. 5 is a perspective view illustrating another embodiment of the string fixing device according to the present invention in its disassembled condition.

FIG. 5 shows another embodiment of the string fixing device according to the present invention.

In this embodiment, the base plate 4 proper is so designed as to be ajustable in its height. Speaking concretely, a pair of tapped holes 4*c* are formed in the base plate 4 at the end thereof nearer the neck 2 and the lower ends of adjusting bolts 13 screwed through the tapped holes 4*c* are received on a plate 14 fixed on the head 3. Accordingly, the base plate 4 directly constitutes the lock members in this embodiment and the lock nuts 11 are not used, unlike the above-mentioned embodiment, to reduce the number of parts used. The other members of this embodiment are equivalent to those used in the embodiment shown in FIGS. 3 and 4 and the strings are fixedly sandwiched between the rectangular washer 6 (pressing member) and the top surface of the base plate 4 under the action of the string fixing bolt 15. In addition, the reference numeral 16 in FIG. 5 represents screws used for fixing the base plate to the head 3. Openings 4*d* bored in the base plate 4 through which the screws 16 are to be inserted have an elongated circular form so as to loosely fit the screws 16. Practically, on the base plate 4 are provided three pieces of the pressing member 6 formed as mentioned-above, in the same manner as in FIG. 4.

What is claimed is:

1. A string fixing device for string instruments comprising: a lock member mounted on the top surface of a head near the boundary between a neck and said head of a string instrument; a pressing member mounted on said lock member for fixedly sandwiching strings between said pressing member and said lock member; string height adjusting means having a screw for adjusting height of said lock member as measured from the top surface of the head by turning said screw into the end of said lock member; and fixing means for fixing about center portion of said lock member on said head, so that said end of said lock member is capable of being raised.

2. A string fixing device for string instruments according to claim 1 wherein said lock member is mounted so that said end of said lock member is capable of being raised up by way of a base plate fixedly attached to the top surface of the head, and said fixing means are clamping screws loosely inserted through said lock member and said pressing member, and engaged with said base plate.

3. A string fixing device for string instruments according to claim 1 wherein said fixing means are clamping screws loosely inserted through an end of said lock member and engaged with the head.

4. A string fixing device for string instruments according to claim 1 wherein said pressing member is formed as rectangular washer capable of fixedly sandwiching two strings simultaneously between said pressing member and said lock member.

* * * * *